US005509971A

United States Patent [19]

Kirschner

[11] Patent Number: 5,509,971

[45] Date of Patent: Apr. 23, 1996

[54] PROCESS FOR REMOVING COATINGS FROM HARD SURFACES

[75] Inventor: Lawrence Kirschner, Flanders, N.J.

[73] Assignee: Church & Dwight Co., Inc., Princeton, N.J.

[21] Appl. No.: 379,284

[22] Filed: Jan. 27, 1995

Related U.S. Application Data

[60] Division of Ser. No. 149,306, Nov. 8, 1993, which is a continuation-in-part of Ser. No. 854,204, Mar. 20, 1992, abandoned.

[51] Int. Cl.[6] ..... B08B 3/00; B08B 5/00; B08B 7/00

[52] U.S. Cl. ..... 134/7; 134/38; 51/309

[58] Field of Search ..... 134/6, 7, 38, 22.12, 134/22.18, 37

[56] References Cited

U.S. PATENT DOCUMENTS

| | | | |
|---|---|---|---|
| 2,624,988 | 1/1953 | Vander Wal | 51/282 |
| 2,710,286 | 6/1955 | Zachariason | 252/301.6 |
| 2,842,465 | 7/1958 | Harrison | 134/7 |
| 2,898,246 | 8/1959 | Hannah | 134/38 |
| 3,060,098 | 10/1962 | Gershon | 167/93 |
| 3,087,857 | 4/1963 | Davis et al. | 167/53.2 |
| 3,775,180 | 11/1973 | Hirata et al. | 134/7 |
| 4,021,525 | 3/1977 | Poncha | 423/184 |
| 4,579,627 | 4/1986 | Brailsford | 156/655 |
| 4,588,444 | 5/1986 | Anderson | 134/2 |
| 4,731,125 | 3/1988 | Carr | 134/17 |
| 4,878,320 | 11/1989 | Woodson | 51/320 |
| 5,112,406 | 5/1992 | Lajoie et al. | 134/7 |
| 5,160,547 | 11/1992 | Kirschner et al. | 134/7 |
| 5,230,185 | 7/1993 | Kirschner et al. | 51/410 |
| 5,232,514 | 8/1993 | Van Sciver et al. | 134/26 |
| 5,290,364 | 3/1994 | Stein et al. | 134/7 |

FOREIGN PATENT DOCUMENTS

| | | |
|---|---|---|
| 3906394 | 9/1990 | Germany . |
| 61-075300 | 4/1986 | Japan . |

*Primary Examiner*—Zeinab El-Arini
*Attorney, Agent, or Firm*—Charles B. Barris

[57] ABSTRACT

A process for removing coatings from hard surfaces includes blasting the surfaces with a free-flowing particulate blast media entrained in a pressurized fluid, the blast media containing a major amount of relatively soft granular abrasive particles which have a Mohs hardness of less than 4.0 and a minor amount of free-flowing, separate relatively hard granular abrasive particles which have a hardness of greater than 5.0 on the Mohs scale, the granular abrasives having a particle size of from about 10 to about 2000 microns and being devoid of crystalline silica material.

10 Claims, No Drawings

PROCESS FOR REMOVING COATINGS FROM HARD SURFACES

This application is a divisional of U.S. patent application Ser. No. 08/149,306, filed Nov. 8, 1993, still pending, which is a continuation-in-part of U.S. patent application Ser. No. 07/854,204, filed Mar. 20, 1992, and now abandoned.

BACKGROUND OF THE INVENTION

This invention relates in general to a process for removing adherent material, such as paint, scale or other coverings from hard surfaces and, more particularly, to a non-chemical surface cleaning process employing blast cleaning using an abrasive which is propelled to the surface in a pressurized fluid stream. For various types of structures, it is often necessary or desirable to remove any layer of coating which has been previously applied to or formed on surface areas. Numerous techniques exit for removing paint, sealants, lacquers, rust, scale and other adherent materials from virtually any type of surface. Surface cleaning or stripping methods range from mechanical abrasion to the use of strong chemicals and involve varying degrees of time, effort and expense. For any given type of coating, the character and function of the substrate material from which a coating is to be removed usually dictates the stripping method, at least in industrial settings.

In view of the environmental and health hazards involved in the use of solvents for cleaning surfaces, in particular, large exterior surfaces, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation. Hard, durable surfaces, such as heavy steel plating can be cleaned or stripped by a hard abrasive such as sand. Softer metals such as aluminum or more delicate surfaces such as polymer composite layers may require the use of a softer abrasive material during blasting such as plastic pellets or sodium bicarbonate.

Sand blasting of steel plate or other hard surface to remove adherent coatings and the like, while successful in removing the coatings, has several disadvantages. For one, the sand abrasive is very friable such that upon contact with the surface, a vast amount of silica dust is formed. Recently there has been a concern that the minute air-borne free-silica particles which are formed during blasting present a substantial health hazard, in particular, if ingested into the lungs. Secondly, very large amounts of sand are required for cleaning large structures such as bridges, stacks, etc. such that after blasting, this sand remains and must be removed from the blast cleaning area adding substantially to the time and expense of the blasting process.

Alternative abrasives for blast cleaning hard surfaces are known. For example, U.S. Pat. No. 3,775,180 is directed to a method for descaling steel in which the steel is descaled by spraying a mixture of a solid such as aluminum oxide or silicon carbide with water and a gas such as air under specified conditions onto the steel. In removing a coating or a scale on the surface of a metal, however, it is important that the anchor pattern (surface roughness) of the metal surface be uniform and not too extensive such that the surface and even the metal structure is damaged. A blast media composed only of hard aluminum oxide and silicon carbide can be detrimental to the metal structure. For certain surfaces such as metals softer than steel, a softer abrasive can be used with the blast stripping method. An example of such is disclosed in U.S. Pat. No. 4,878,320 to remove coatings from aluminum, fiber glass or carbon fiber laminate. As disclosed in the patent, an abrasive particle is used which has a Mohs hardness of about 3. Sodium bicarbonate is the preferred material. Likewise, the present assignee markets a sodium bicarbonate blast media under the tradename Armex® for removing paint, scale, dirt, grease and the like from aluminum, stainless steel, and non-metallic surfaces. A large advantage of sodium bicarbonate as a blast media is that the material is water soluble and non-toxic so that a blasting area can be cleaned relatively easily by washing the abrasive blast media away with water without a harmful environmental effect. Although very effective for removing coatings from aluminum or other softer materials such as polymer composites and the like, sodium bicarbonate abrasive is not hard enough to provide a sufficient anchor pattern on hard surfaces such as steel so as to prepare the surface for the addition of a new coating layer.

Other patents which disclose cleaning metal surfaces with an abradant other than sand include U.S. Pat. No. 2,624,988 which utilizes a mixture of Tripoli paste and a liquid vehicle to which mixture can be added sponge rubber fragments which carry the abradant to the metal surface and which provide a rubbing action to polish and buff the metal surface. The addition of a small amount of alumina to the Tripoli paste is disclosed under certain conditions.

U.S. Pat. No. 2,710,286 discloses a method of removing fluorescent and other materials from viewing screens of cathode ray tubes in which sodium and potassium carbonate are used as the abrasive material. U.S. Pat. No. 4,588,444 discloses removing calcium from polymeric contact lenses by using as an abradant sodium chloride, sodium bicarbonate or a mixture of same. U.S. Pat. No. 4,731,125 discloses a method for removing adherent material from composite surfaces made of a reinforced matrix material using a granular media composed of particles which have a Mohs hardness of lower than 3.5. Preferably the abradant is polymeric particles having the desired Mohs hardness.

SUMMARY OF THE INVENTION

The present invention is directed to removing coatings such as paints, adhesives, etc. as well as scale and rust from hard surfaces including structural steel surfaces by a blast cleaning process. It is an object of the invention to utilize an abrasive blast media which is not harmful to the environment and which can provide a uniform and sufficient anchoring pattern on the hard surface without providing an excessive anchor pattern such as to damage the surface or the structure.

The above objects are achieved by providing an abrasive blast media which comprises a mixture of a relatively soft abrasive and a minor amount of a hard abrasive. The blast media is propelled to the surface by a carrier medium of high pressure air, water or a mixture of air and water to remove the coating layers and provide a uniform anchoring pattern.

DETAILED DESCRIPTION OF THE INVENTION

In its broadest aspect, the abrasive blast media of the present invention comprises a relatively soft material which is capable of removing coatings by a blast cleaning process and the inclusion therein of minor amounts of a relatively hard substance which is capable of providing a sufficient although not too extensive anchor pattern on hard surfaces. Thus, the major portion of the abrasive blast media will comprise abrasives which have a hardness of less than 4.0, preferably, less than 3.5 on the Mohs scale. Non-limiting examples of useful soft abrasives include alkali and alkaline earth metal carbonates including trona (natural sodium sesquicarbonate), sodium sesquicarbonate, sodium bicarbonate, sodium carbonate, potassium carbonate, potassium bicarbonate, magnesium carbonate, calcium carbonate, etc. Other useful soft abrasives include plastic media, rice hulls, walnut shells, etc. It is most preferred that the soft abrasive be water soluble to greatly reduce clean-up costs and environmental problems. Non-limiting examples of water soluble blast media which can be utilized include the water soluble alkali metal and alkaline earth metal salts such as the chlorides, chlorates, carbonates, bicarbonates, sulfates, silicates, the hydrates of the above, etc. The preferred blast media are the alkali metal salts and, in particular, the sodium and potassium carbonates, bicarbonates, silicates and sulfates. The most preferred blast media are the alkali metal bicarbonates as exemplified by sodium bicarbonate. Also preferably useful are sodium sesquicarbonate, natural sodium sesquicarbonate known as trona, sodium carbonate, potassium carbonate, potassium bicarbonate, sodium chloride and sodium sulfate which is described as a blast media abrasive in commonly assigned U.S. Pat. No. 5,112,406. It is important to note that by water soluble is not meant completely water soluble as some natural minerals including the preferred trona may contain minor amounts of insoluble materials. For example, trona may contain up to 10 wt. % insolubles. Besides being water soluble, it is also preferred that the soft blasting media be nontoxic and capable of being washed away from the blasting site without adversely effecting the environment. It is preferred that the soft abrasive of the blasting media of this invention be devoid of free crystalline silica materials which can cause health problems such as silicosis.

The minor component of the abrasive blast media of this invention is a hard abrasive which can provide a sufficient anchor pattern on a hard surface such as steel and, since used in only minor amounts does not adversely effect the mechanical integrity of the structure being blast cleaned for the removal of coating layers. In its broadest aspect, the blast media of the present invention encompasses the use of a minor amount of a hard abrasive having a hardness of at least 5.0, preferably at least 6.0 and even about 7.0 and above on the Mohs scale. Non-limiting examples include aluminum oxide, silicon carbide, tungsten carbide, garnet, Starblast®, etc. It is preferred to avoid materials such as sand which is mainly composed of crystalline silica which may form air-borne minute particles and pose a considerable health hazard. The preferred hard abrasive is aluminum oxide.

The most preferred blast media of this invention which is particularly useful in removing coatings either applied or formed on harder surfaces such as steel comprises a mixture of a major amount of trona or sodium bicarbonate particles and a minor amount relative to the soft abrasive of aluminum oxide particles. The trona and bicarbonate abrasives are particularly useful as abradants to remove coatings such as paints, adhesives, sealants, scale, rust and the like by blast cleaning but, used alone, have been found to be too soft to provide a white metal surface or sufficient anchor pattern on a hard metal surface such as steel so as to provide acceptable adherence of a coating layer applied subsequent to blasting. On the other hand, while alumina oxide and other hard abradants such as silicon carbide have been suggested for use as a blast media to remove coatings from steel, the use of these very hard abradants alone are believed to actually damage the surface and the structure itself which is being blasted. As a mixture in accordance with this invention, surface cleaning is readily accomplished and a desired anchor pattern can be provided without harm to the substrate surface.

The blast media of the present invention containing a mixture of soft abrasive and hard abrasive must be relatively free-flowing and contain less than about 1 wt. % free moisture to avoid excessive agglomeration of the individual abrasive particles and which may adversely effect particle flow through the supply and blasting equipment. The particle size of the abrasive particulates will range from about 10 to 2,000 microns, preferably from about 30 to about 500 microns for both the soft and hard abrasives. It has been found that a free-flowing blast media comprising 55–95% by weight, preferably 70–95% by weight of the soft abrasive particles and 5–45% by weight, preferably 5–30% by weight of the hard abrasive particles sufficiently removes the desired coating by any blast cleaning process and at the same time provides a uniform and adequate surface anchor pattern without damaging the surface or structure of the substrate.

It may also be useful in accordance with the present invention to include a flow aid or an anticaking agent with the blast media. Most preferably, the flow aid is a hydrophilic silica, hydrophobic silica, hydrophobic polysiloxane or mixture thereof.

Hydrophobic silica, unlike known hydrophilic silicas, is substantially free of hydrogen bonded silanol groups and absorbed water. One preferred hydrophobic silica which may be utilized in the blasting media hereof is Aerosil R 972, a product which is available from DeGussa AG. This material is a pure coagulated silicon dioxide aerosol, in which about 75% of the silanol groups on the surface thereof are chemically reacted with dimethyldichlorosilane, the resulting product having about 0.7 mmol of chemically combined methyl groups per 100 $m^2$ of surface area and containing about 1% carbon. Its particles vary in diameter from about 10 to 40 nanometers and have a specific surface area of about 110 $m^2$/gram. It may be prepared by flame hydrolysis of a hydrophilic silica as more fully described in Angew. Chem., 72, 744 (1960); F-pS 1,368,765; and DT-AS 1,163,784. Further details respecting such material are contained in the technical bulletin entitled "Basic Characteristics and Applications of AEROSIL" DeGussa AG, August 1986. The hydrophobic silica particles are admixed with the abrasive blasting agent in the proportion of at least about 0.1 and up to about 1.0% by weight thereof. Another hydrophobic silica is Quso, marketed by DeGussa A.G.

Hydrophobic polysiloxanes, preferably nonhalogenated polysiloxanes, suitable for use in the blasting media hereof are commercially marketed by Dow Corning and General Electric.

The blast media is applied to the surface by use of any known type of blasting equipment in which a pressurized fluid is used as the carrier for the abrasive blast media. Typically, the blast media in the fluid carrier is accelerated and directed to the substrate surface by means of a venturi nozzle in which the pressurized fluid is accelerated by passage through a restricting orifice and directed to the targeted surface through an expanding outlet section of the nozzle. The venturi nozzle is usually a hand held device, although, automatic operation may be useful in some situations. Air under a pressure of from about 30 to 150 psi can be utilized as the carrier medium for the blast media. A secondary source of relatively low pressure water can be added to the carrier either interior or exterior of the blast nozzle to hold down dust during blasting. It is also preferable to use high pressure water alone or in combination with air as the carrier fluid. High pressure water of at least about 1,000 psi, typically at least 3,000 psi, can be effectively used as a carrier fluid. High pressure water as the carrier for the blast media has found increasing use since it is less costly to pressurize water than to compress air to the pressures needed to carry the abrasives to the targeted surface. The type of nozzle equipment used to direct the high pressure liquid stream into contact with a surface is not critical to the invention as long as such equipment is capable of producing a coherent stream of liquid. High pressure water blasting equipment can be obtained from a variety of sources including "Aqua-Dyne® High Pressure Water Jet Blaster" and "Dyna-Grit" wet abrasive blast system from Aqua-Dyne Inc., Houston Tex., and "Aqua-Miser" blasting equipment from Carolina Equipment and Supply Co., Inc., North Charleston, S.C. such as described in U.S. Pat. No. 5,220,935 herein incorporated by reference.

Liquids other than water can be added or used for the high pressure liquid stream including materials which increase specific gravity and/or reduce water viscosity such as water soluble resins although the expense of such materials may be prohibited in a wet blasting process. The water stream may include additives in minor amounts to improve the flow of the water through the blasting equipment or to improve the stripping process or may even include additives which provide a post-treatment onto the targeted surface. For example, the water stream may include as an additive detersive agents such as surfactants to enhance the removal of the contaminants from the substrate surface. Post-treatment agents which can be added to the water stream include sanitizers, rust-proofing agents, etc. which beneficially treat the targeted surface subsequent to the removal of the coatings and the like therefrom.

The addition of the abrasive particles to the high pressure liquid stream can be achieved by a variety of ways. For example, the abrasive particles can be added to the liquid stream by aspiration, by means of compressed air or by mixture in a slurry. If the relatively soft abrasive is water soluble, it has been found advantageous to avoid substantial dissolution of the abrasive particles prior to contact with the substrate surface. Dissolution of the water soluble abrasive particles is avoided by saturating the high pressure water stream with the abrasive and then forming a slurry of additional solid abrasive in the saturated water stream. Commonly assigned, copending application Ser. No. 08/105,406, filed Aug. 12, 1993 discloses wet blasting with slurries of solid, water-soluble abrasives in saturated aqueous solutions and the advantages thereof in maintaining the mass and cutting edges of the particulate abrasive. The contents of this copending application are herein incorporated by reference.

The soft and hard abrasive may be premixed prior to being entrained in the carrier stream or such materials may be withdrawn from separate containers by known methods in which preferably the hard abrasive is carefully metered into the soft abrasive stream.

The invention will now be illustrated by the following examples which are not to be construed as limiting the scope of the appended claims to strictly those embodiments shown.

EXAMPLES 1–3

Five different blast media compositions were prepared. The compositions for each blast media are set out in Table 1. Sample Nos. 2, 3 and 4 represent blast media falling within the scope of the present invention while Samples 1 and 5 are comparative examples.

TABLE 1

| Sample No. | Ingredients | Percent |
|---|---|---|
| 1 | Armex Maintenance grade[1] | 90 |
| | Ferrosil 14[2] | 10 |
| 2 | Alkaten[3] | 90 |
| | Brown Aluminum Oxide 70[4] | 10 |
| 3 | Alkaten | 95 |
| | Brown Aluminum Oxide 70 | 5 |
| 4 | Alkaten | 95 |
| | Starblast XL[5] | 5 |
| 5 | Armex Maintenance grade | 100 |

[1]Sodium bicarbonate, average particle size of 150 microns, Church & Dwight, Princeton, N.J.
[2]Very fine feriosilicate, 98% less than 14 microns, Garnet Mineral
[3]Ground trona (natural sodium sesquicarbonate), average particle size about 250 microns, Church & Dwight
[4]Average particle size of about 350 microns
[5]Staurolite Residue, average particle size of about 150 microns, DuPont

Example 1

Five different steel panels containing either mill scale, light rust, heavy rust or a coating of lead paint were blasted with the five sample compositions set forth in Table 1 using air under 85 psi pressure as the carrier. The painted panels comprised lead paint on steel in which the steel surface was solvent cleaned but did not contain an original profile nor was the mill scale removed. The results are shown in Table 2.

All of the abrasive samples which were tested flowed reasonably well with the exception of Sample 1. It is believed that the mixing of the Ferrosil with the sodium bicarbonate caused a breakdown in the particle size of the sodium bicarbonate and that therefore the flowability of the sample was adversely affected by the smaller granules of the bicarbonate.

Samples 2, 3 and 4 flowed well and had improved efficiency as far as coatings removal. Sample 2 performed best overall.

TABLE 2

| Sample No. | Mill Scale Removal Qual[1] | Mill Scale Removal Gauge[2] | Lite Rust[3] Removal | Heavy Rust[4] Removal | Average Paint Thickness Removal (mil) | Average Strip time (sec.) Per Sq. Ft. |
|---|---|---|---|---|---|---|
| 1 | 2 | 100 | 10 | 4 | 3.2 | 30.5 |
| 2 | 7 (SP6)[6] | 600 (1.1 mil)[7] | 7 | 7 | 3.2 | 16 |
| 3 | 5 (SP7)[6] | 375 | 8 | 7 | 3.2 | 13 |
| 4 | 3 (SP7) | 375 | 8 | 8 | 3.2 | 20 |
| 5 | No rating | | 9* | 4 | 3.6 | 28 |

[1]Mill Scale removal rated 1–10 (pure Starblast = 10). (Qualitative)
[2]Profile rating 0–1000 using comparative gauge, with uncoated sandblasted panel rated 700.
[3]Lite Rust removal rated 1–10 (pure Starblast = 10). (Qualitative)
[4]Heavy rust removal rated 1–10 (pure Starblast = 10). (Qualitative)
[5]SSPC Standard for surface preparation. SP6 equivalent to Commercial Blast Cleaning Standard which is blast cleaning until at least two-thirds of the surface area is free of all visible residues.
[6]SP7 Brush-off Blast Cleaning Standard which is blast cleaning of all except tightly adhering residues of mill scale, rust and coatings
[7]Profile produced measured by Testex tape Sand = 3.1 mil, Starblast = 1.6 mil
*High value obtained for completeness, but removal was slower than other samples.

Example 2

In this example four steel sheets which were painted with a lead paint were mechanically blasted as in Example 1. The steel panels were prepared via sand blasting prior to the application of the lead paint. Results are shown in Table 3.

TABLE 3

| Sample No. | Average Paint Thickness Removal (mil) | Average Strip Time (sec.) Per Sq. Ft. |
|---|---|---|
| 1 | 2.5 | 35 |
| 2 | 2.5 | 26 |
| 3 | 2.5 | 28 |
| 4 | 2.5 | 37 |
| 5 | 2.9 | 31 |

Example 3

In this example, the steel panels were coated with an epoxy paint. The panels were solvent cleaned previous to application of the coating as in Example 1. The results are shown in Table 4.

TABLE 4

| Sample No. | Paint Thickness Removal (mil) | Strip Time (sec.) Per Sq. Ft. |
|---|---|---|
| 1 | 7.9 | 60 |
| 2 | 8.0 | 51 |
| 3 | 8.2 | 53 |
| 4 | 8.0 | 73 |
| 5 | 7.7 | 47 |

EXAMPLES 4–6

Four blast media samples were prepared. The compositions for each blast media sample are set out in Table 5.

TABLE 5

| Ingredients | Compositions (%) A | B | C | D |
|---|---|---|---|---|
| Sodium Bicarbonate[1] | 100 | 90 | 90 | 90 |
| Aluminum Oxide[2] | — | 10 | — | — |
| Starblast ® XL[3] | — | — | 10 | — |
| Garnet 30 × 60[4] | — | — | — | 10 |
| Total | 100 | 100 | 100 | 100 |

Notes:
[1]Sodium Bicarbonate, MP-grade, Church & Dwight Co., Inc., Princeton, NJ
[2]Aluminum Oxide, Grit #70, AGSCO Corp., Wheeling, IL
[3]Starblast ® XL, DuPont
[4]Garnet 30 × 60, Barton Mines Corp., Golden, CO

Example 4

Four carbon steel panels containing heavy rust were blasted with the four blast media samples. The blasting process was performed using the ACCUSTRIP™ SYSTEM blast machine at 80 psi air pressure and 3 lbs/min blast media flow rate. The results are shown in Table 6.

TABLE 6

| Sample | Heavy Rust Removal Results |
|---|---|
| A | Near white metal surface (Loosely adhered rust particles were removed but tightly adhered ones were not removed.) |
| B | White metal surface (All rust particles were completely removed.) |
| C | White metal surface (All rust particles were completely removed.) |
| D | White metal surface (All rust particles were completely removed.) |

Example 5

Four new carbon steel panels containing mill scale were blasted with the four media samples using the same blasting process as in Example 4. Profiles (or anchor patterns) of the blasted surfaces were measured using the Testex tape. Results are shown in Table 7.

TABLE 7

| Sample | Profile (mils) |
|---|---|
| A | 0 |
| B | 1.9 |
| C | 1.8 |
| D | 2.5 |

Example 6

Mild steel panels were coated with two coats of an epoxy polyamide paint. The panels were blasted to white metal surface using sand prior to application of the coatings. The coatings were removed using the same blasting process as in Example 4, except at varying blast media flow rates. Results are shown in Table 8.

TABLE 8

| Blast Media Flow Rate | Coatings Removal Rate (mil-sq-ft/min) | |
|---|---|---|
| (lbs/min) | Sample A | Sample B |
| 3 | 6.1 | 7.6 |
| 4 | 7.9 | 10.0 |
| 5 | 9.4 | 11.8 |

What is claimed is:

1. A process for removing coatings from hard surfaces comprising blasting said surfaces with a free-flowing particulate blast media entrained in a pressurized fluid, said blast media comprising a major amount of relatively soft granular abrasive particles which have a Mohs hardness of less than 4.0 and a minor amount of free-flowing, separate relatively hard granular abrasive particles which have a hardness of greater than 5.0 on the Mobs scale, said granular abrasives having a particle size of from about 10 to about 2000 microns and being devoid of crystalline silica material.

2. The process of claim 1 wherein said relatively soft granular abrasive is water soluble.

3. The process of claim 2 wherein said relatively soft granular abrasive is trona, sodium bicarbonate or sodium sulfate.

4. The process of claim 2 wherein said relatively hard granular abrasive is aluminum oxide.

5. The process of claim 2 comprising 55 to 95% by weight trona, sodium bicarbonate or sodium sulfate as said relatively soft granular abrasive and 5 to 45% by weight aluminum oxide as said relatively hard granular abrasive.

6. The process of claim 5 wherein said relatively soft granular abrasive is sodium bicarbonate.

7. The process of claim 1 wherein said pressurized fluid is air under a pressure of from about 30 to 150 psi.

8. The process of claim 1 wherein said pressurized fluid is water under a pressure of at least 1,000 psi.

9. The process of claim 8 wherein said water is under a pressure of at least 3,000 psi.

10. The process of claim 1 wherein said hard surfaces comprise steel.

* * * * *

UNITED STATES PATENT AND TRADEMARK OFFICE

CERTIFICATE OF CORRECTION

PATENT NO. : 5,509,971
DATED : April 23, 1996
INVENTOR(S) : Lawrence Kirschner

It is certified that error appears in the above-indentified patent and that said Letters Patent is hereby corrected as shown below:

Claim 1, at Column 10, line 9, change "Mobs" to -- Mohs--.

Signed and Sealed this

Eighth Day of October, 1996

*Attest:*

*Attesting Officer*

BRUCE LEHMAN

*Commissioner of Patents and Trademarks*